US009666931B2

(12) United States Patent
Suzuki

(10) Patent No.: US 9,666,931 B2
(45) Date of Patent: May 30, 2017

(54) RADIO FREQUENCY ELECTRIC POWER CONVERSION MECHANISM

(71) Applicant: NIDEC ELESYS CORPORATION, Kawasaki-shi, Kanagawa (JP)

(72) Inventor: Jun Suzuki, Kawasaki (JP)

(73) Assignee: NIDEC ELESYS CORPORATION, Kanagawa (JP)

( * ) Notice: Subject to any disclaimer, the term of this patent is extended or adjusted under 35 U.S.C. 154(b) by 122 days.

(21) Appl. No.: 14/833,313

(22) Filed: Aug. 24, 2015

(65) Prior Publication Data

US 2016/0093936 A1 Mar. 31, 2016

(30) Foreign Application Priority Data

Sep. 30, 2014 (JP) ..... 2014-202127

(51) Int. Cl.

| | |
|---|---|
| ***H01P 3/12*** | (2006.01) |
| ***H01P 5/107*** | (2006.01) |
| *H01P 5/08* | (2006.01) |

(52) U.S. Cl.

CPC ..... *H01P 5/107* (2013.01); *H01P 3/121* (2013.01)

(58) Field of Classification Search

CPC ..... H01P 3/12; H01P 3/121; H01P 5/08

USPC ..... 333/26, 246, 248

See application file for complete search history.

(56) References Cited

U.S. PATENT DOCUMENTS

| | | | | |
|---|---|---|---|---|
| 7,522,014 | B2 * | 4/2009 | Koriyama | H01L 23/66 333/246 |
| 7,911,292 | B2 * | 3/2011 | Byun | H01P 5/107 333/26 |
| 8,188,805 | B2 * | 5/2012 | Nomura | H01P 5/107 333/26 |
| 8,536,954 | B2 * | 9/2013 | Leiba | H01L 23/66 333/247 |
| 8,866,562 | B2 * | 10/2014 | Shimura | H01P 5/024 333/21 R |
| 2011/0057741 | A1 * | 3/2011 | Dayan | H01P 5/107 333/26 |

FOREIGN PATENT DOCUMENTS

| | | | |
|---|---|---|---|
| JP | 10-256730 | A | 9/1998 |
| JP | 2000-183233 | A | 6/2000 |
| JP | 2001-036209 | A | 2/2001 |
| JP | 2004-112131 | A | 4/2004 |
| JP | 2005-142884 | A | 6/2005 |
| JP | 2007-329908 | A | 12/2007 |
| JP | 2011-61290 | A | 3/2011 |
| JP | 2013-172251 | A | 9/2013 |

* cited by examiner

*Primary Examiner* — Dean Takaoka
(74) *Attorney, Agent, or Firm* — Keating & Bennett, LLP

(57) ABSTRACT

A radio frequency electric power conversion mechanism of the present invention includes a circuit board including a fiber reinforced resin board, instead of an expensive ceramic circuit board. The radio frequency electric power conversion mechanism has a combined configuration of a plurality of fiber reinforced resin boards laminated to each other with a conductive foil therebetween, a via hole array made of an electric conductor passing through the boards, a transmission line closely adhered to the surface of a board, and a waveguide having a notch in a part of the waveguide on the aperture side. The radio frequency electric power conversion mechanism further has other structural features.

20 Claims, 5 Drawing Sheets

RADIO FREQUENCY ELECTRIC POWER CONVERSION MECHANISM

BACKGROUND OF THE INVENTION

1. Field of the Invention

The present invention relates to a radio frequency electric power conversion mechanism.

2. Description of the Related Art

A radio frequency electric power conversion mechanism provided with a transmitter-receiver circuit and a waveguide is used when, for example, an electromagnetic wave having a short wavelength such as millimeter waves or microwaves used for a vehicle radar is transmitted or received by means of an antenna using the transmitter-receiver circuit. Such a transmitter-receiver circuit is integrated, for example, as a monolithic microwave integrated circuit (MMIC), in a substrate provided with a waveguide, a microstripline and a patch electrode. Radio frequency electric power emitted from the MMIC is converted into an electromagnetic wave in a certain transmission mode by means of the microstripline and the patch electrode and transmitted through the waveguide. On the other hand, the electromagnetic wave transmitted by the waveguide is converted into an electromagnetic wave in another transmission mode by means of the patch electrode and the microstripline and transmitted to the MMIC (see, for example, Japanese Patent Laid-Open No. 2013-172251).

SUMMARY OF THE INVENTION

The circuit board provided with the MMIC, the waveguide, the microstripline and the patch electrode described above causes a high production cost because of use of an expensive ceramic circuit board, for example, as disclosed in Japanese Patent Laid-Open No. 2013-172251.

The present invention has been made in view of the above problem, and an object of the present invention is to provide a radio frequency electric power conversion mechanism capable of reducing production cost.

A radio frequency electric power conversion mechanism of a first aspect of the present invention is a radio frequency electric power conversion mechanism including a waveguide and a circuit board having a plurality of fiber reinforced resin boards and a conductive foil, including:

a monolithic microwave integrated circuit (MMIC);

a first board made of fiber reinforced resin;

a transmission line which is a strip-like foil or a wire made of an electric conductor, the transmission line being adhered to the upper surface of the first board and having one end connected to the MMIC;

a first foil made of an electric conductor, the first foil being adhered to a lower surface of the first board and covering at least a region of the lower surface under a region where the transmission line is disposed;

a second board made of fiber reinforced resin and adhered to a lower surface of the first foil;

a second foil made of an electric conductor and adhered to a lower surface of the second board;

a waveguide extending in a direction away from the upper surface of the first board and including a cavity having a square-shaped cross-section therein; and at least one surface layer via hole that is a conductive tube or pole passing through at least the first board and the second board, connected to the second foil, and having an upper end exposed to a surface of the circuit board; wherein the waveguide has a square-shaped aperture on its lower end;

the at least one surface layer via hole includes a plurality of surface layer via holes, and at least part of the surface layer via holes constitutes an array surrounding at least three sides of the other end of the transmission line;

a lower end surface of the waveguide is adhered to upper end surfaces of the surface layer via holes constituting the array;

the array includes long side portions and short side portions where the surface layer via holes are arrayed along a long side and a short side of the aperture, respectively;

the surface layer via holes constituting the array are not positioned inside the aperture, as seen through the waveguide;

the array includes a gate portion where the array of the via holes is broken off in entirely one of the long side portions or in a part of the long side portions;

the waveguide has a notch opening toward the lower end surface in the side surface of the lower end of the waveguide;

the transmission line passes through the gate portion and reaches the inside of the array;

the notch is located over at least a region of the gate portion through which the transmission line passes;

the second foil covers at least a region of the lower surface of the second board located on an inner side of the array;

the MMIC is disposed in one of the upper and lower surfaces of the first or second board; and the first foil, the second foil and the surface layer via holes constituting the square-shaped array are grounded.

The configuration of the present invention as described above can reduce production cost of a radio frequency electric power conversion mechanism.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

An preferred embodiment of a radio frequency electric power conversion mechanism of the present invention will be described with reference to FIGS. 1 to 6.

Figure 1:
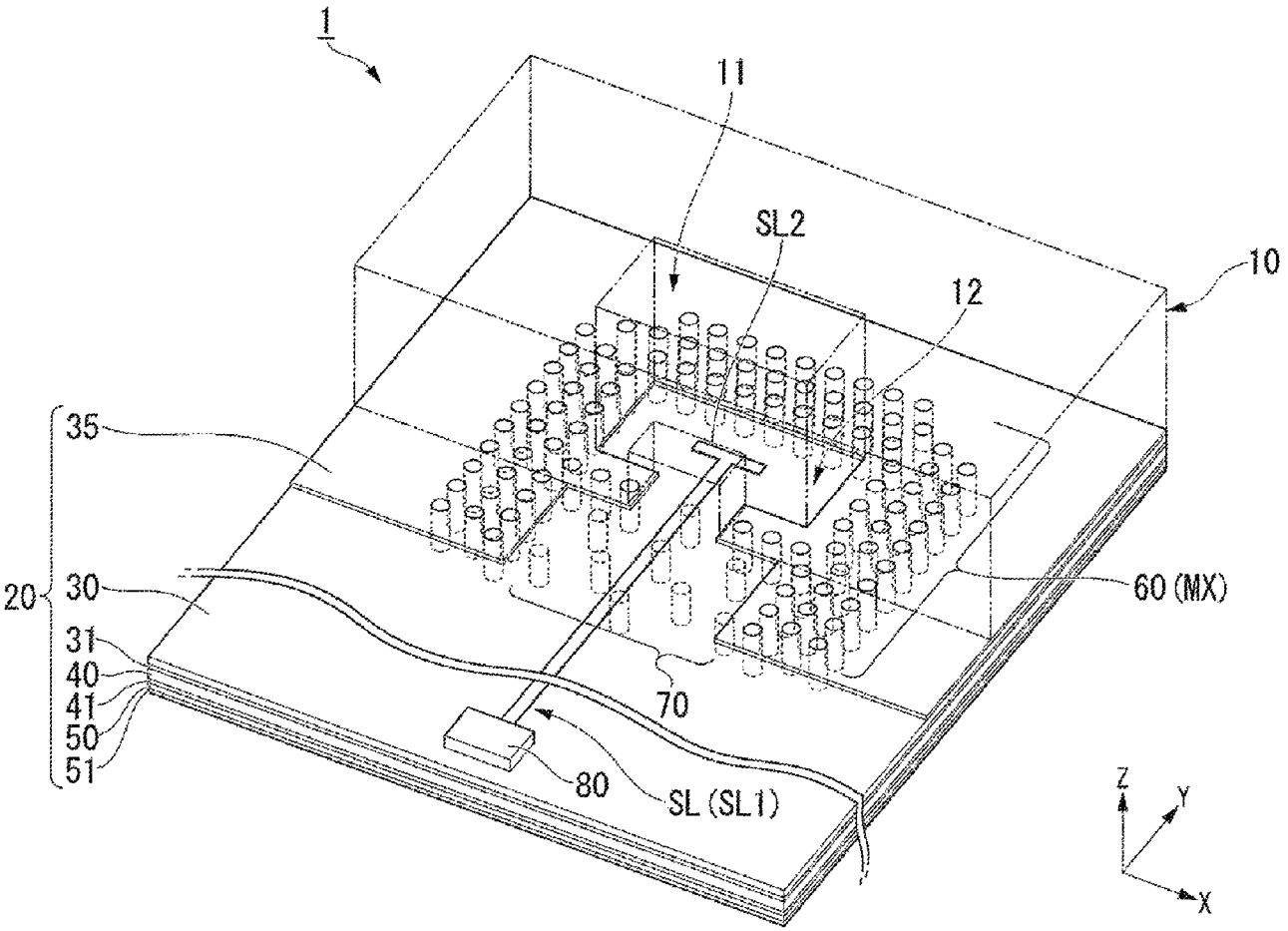
FIG. 1 is a perspective view of a radio frequency electric power conversion mechanism, showing an preferred embodiment of the present invention.

FIG. 1 is a perspective view of a radio frequency electric power conversion mechanism 1.

The radio frequency electric power conversion mechanism 1 includes a waveguide 10 and a circuit board 20. The circuit board 20 includes a first board 30, a second board 40, a third board 50, a transmission line SL, a conductive foil 35, a first foil 31, a second foil 41, a third foil 51, a plurality of surface layer via holes 60 and a plurality of inner layer via holes 70. The circuit board 20 is provided with a monolithic microwave integrated circuit (MMIC) 80.

In the drawings, an X-Y-Z coordinate system is optionally shown as a three-dimensional orthogonal coordinate system. Illustratively, a Z axial direction is a direction in which the waveguide 10 is provided relative to the circuit board 20 shown in FIG. 1, a Y axial direction is a direction in which the transmission line SL extends perpendicular to the Z axial direction and an X axial direction is a direction perpendicular to the Z axial direction and the Y axial direction. In the drawings, optionally illustratively, the upper side is the plus Z side and the lower side is the minus Z side. Also, in the drawings, to facilitate understanding of a configuration of the circuit board 20, the waveguide 10 is optionally shown by a long dashed double-short dashed line.

The waveguide 10 is a transmission line to transmit a radio frequency electromagnetic wave. The waveguide 10, as an example, may be made of aluminum. The waveguide 10 is placed in the upper surface of the circuit board 20. The waveguide 10 extends in a direction away from the upper surface of the first board 30 and includes a cavity 11 having a square-shaped cross-section therein. The radio frequency electromagnetic wave is transmitted inside the cavity 11. The waveguide 10 has a square-shaped aperture 12 in its lower end. The lower end surface of the waveguide 10 is adhered to the upper end surfaces of the surface layer via holes 60 described later.

Figure 2:
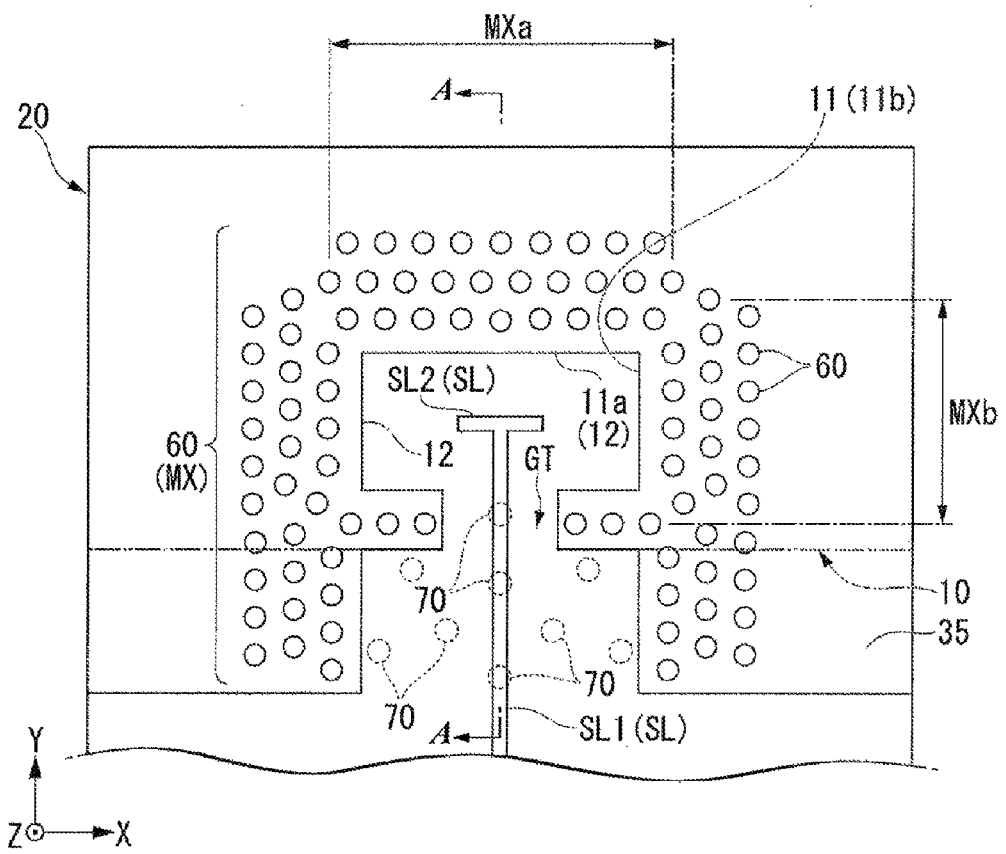
FIG. 2 is a plan view partially showing a circuit board 20 on the plus Y side.

The waveguide 10 may be, as an example, connected to an antenna on the upper end portion of the waveguide 10. FIG. 2 is a plan view partially showing the circuit board 20 on the plus Y side. As shown by the long dashed double-short dashed line in FIG. 2, a long side 11*a* of the cavity 11 in the cross-section of the waveguide 10 may be, as an example, equal to or larger than a half of a wavelength of a radio frequency electromagnetic wave in air, generated by the MMIC 80, and smaller than the wavelength of the radio frequency electromagnetic wave in air, generated by the MMIC 80. The short side 11*b* of the cavity 11 may be, as an example, equal to or larger than a quarter of the wavelength of the radio frequency electromagnetic wave in air, generated by the MMIC 80, and equal to or smaller than a half of the wavelength.

Figure 3:
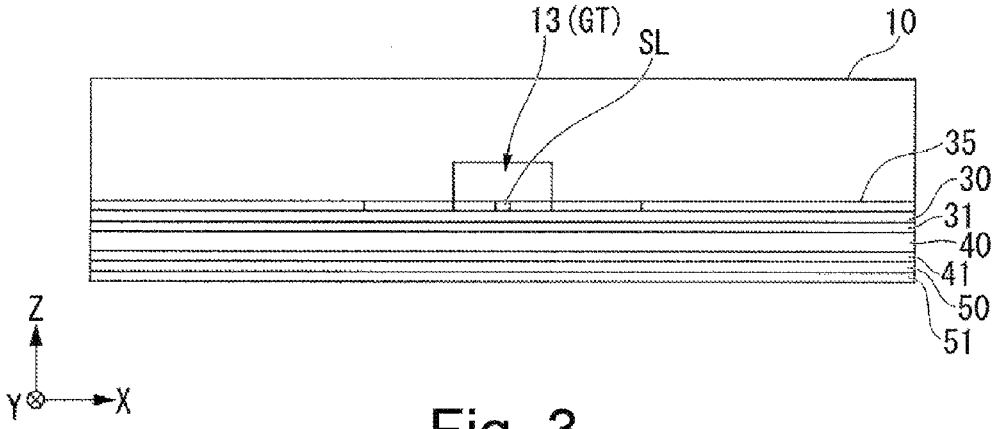
FIG. 3 is an elevation view of a waveguide 10 and the circuit board 20 in FIG. 2, as seen from the minus Y side.

FIG. 3 is an elevation view of the waveguide 10 and the circuit board 20 shown in FIG. 2, as seen from the minus Y side. As shown by a solid line in FIG. 3, the waveguide 10 has a notch 13 opening toward the lower end surface in the side surface on the minus Y side of the lower end of the waveguide 10.

The first board 30 is made of fiber reinforced resin. The fiber reinforced resin is a raw material provided by impregnating a fiber material with resin. As the fiber material, a glass fiber and a carbon fiber may be used. An epoxy resin, a polyamide resin and a phenol resin are applicable as the resin. In this preferred embodiment, the first board 30 is made of a glass fiber reinforced epoxy resin. In the surface layer of the upper surface of the first board 30, the transmission line SL and the conductive foil 35 are disposed.

The transmission line SL is a strip-like foil made of an electric conductor and adhered to the upper surface of the first board 30. The transmission line SL may be, as an example, made of pure copper or copper alloy. As described later, for the transmission line SL, at least part of its surface may be covered with gold. The transmission line SL having at least the part of its surface covered with gold is also suitable for applications in which wire bonding is carried out by using gold.

The transmission line SL is connected at its one end to the MMIC 80. The transmission line SL includes a first stripline SL1 and a second stripline SL2. The first stripline SL1 extends parallel to the short side 11*b* of the cavity 11. The end of the first stripline SL1 on the minus side along Y axis direction is connected to the MMIC 80. The second stripline SL2 extends in the X axis direction and is connected to the end on the plus side along Y axis direction of the first stripline SL1. The second stripline SL2 forms a radiation element when the MMIC 80 generates a radio frequency electromagnetic wave. The second stripline SL2 forms a receiving element when the MMIC 80 receives a radio frequency electromagnetic wave. The length of the second stripline SL2 is equal to or larger than a quarter of a wavelength of a radio frequency electromagnetic wave in the upper surface of the first board 30, generated by the MMIC 80, and equal to or smaller than a half of the wavelength. Note that a modification in which the second stripline SL2 is not present may be implemented. However, providing the second stripline SL2 can enhance radiation efficiency of the radio frequency electromagnetic wave from the end of the first stripline SL1 toward the waveguide.

The conductive foil 35 may be, as an example, made of pure copper or copper alloy. The conductive foil 35 is adhered to the upper surface of the first board 30. The conductive foil 35 is grounded. That is, the conductive foil 35 is at the ground potential. The conductive foil 35, as shown in FIG. 2, is disposed at a position where it contacts with the waveguide 10 in the upper face of the first board 30. As described later, in the upper face of the first board 30, the conductive foil 35 connects the plurality of surface layer via holes 60 to one another. The conductive foil 35 is not disposed at a position where the upper face of the first board 30 faces to the cavity 11 and where the inner layer via holes 70 are arranged.

Figure 4:
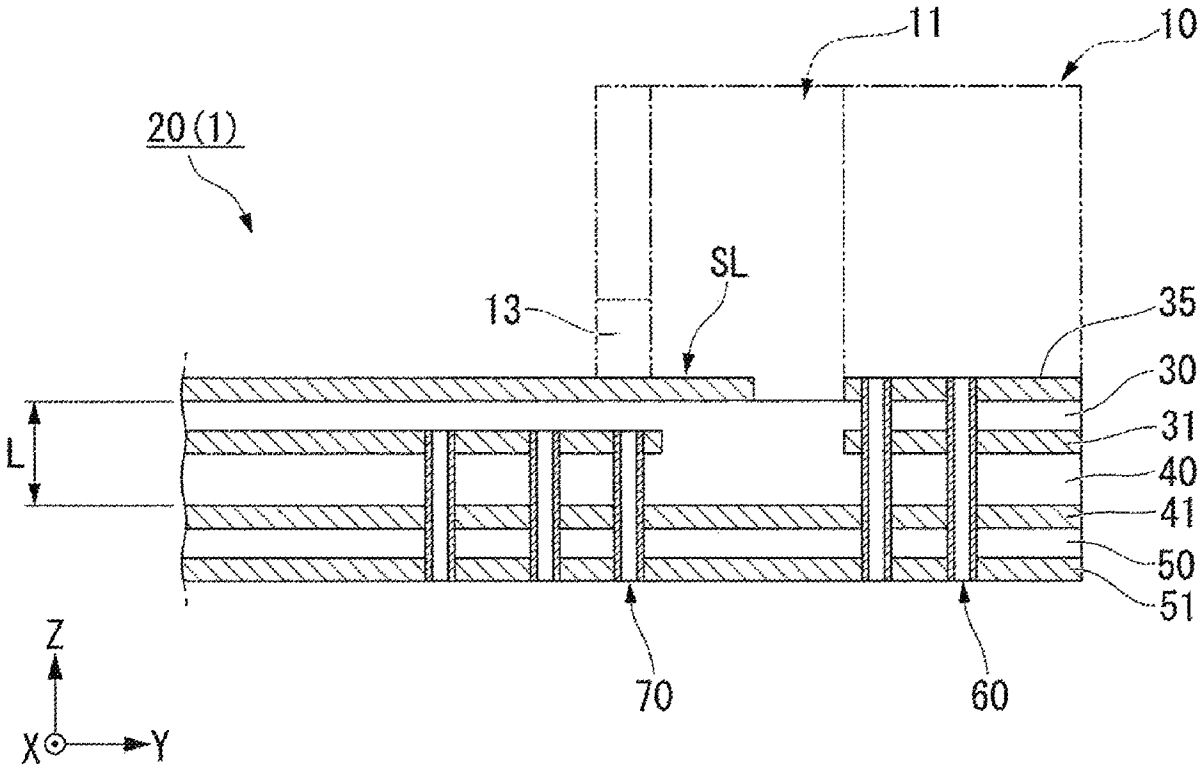
FIG. 4 is a cross-sectional view taken along the line A-A in FIG. 2.

FIG. 4 is a cross-sectional view taken along the line A-A in FIG. 2.

As shown in FIG. 4, the surface layer via holes 60 pass through the first board 30, the second board 40 and the third board 50. The surface layer via holes 60 are connected to the first foil 31 and the second foil 41. Upper ends of the surface layer via holes 60 are exposed to the surface of the circuit board 20. Lower ends of the surface layer via holes 60 are connected to the third foil 51. Each of the surface layer via holes 60 is a conductive tube. Each of the surface layer via holes 60 may be a conductive pole.

As shown in FIG. 2, the surface layer via holes 60 form an array MX surrounding at least three sides of the second stripline SL2 disposed in the end of the transmission line SL on the plus side along Y direction and a part of the first stripline SL1. The surface layer via holes 60 constituting the array MX are not situated inside the aperture 12, as seen through the waveguide 10.

The array MX includes a long side portion MXa where the surface layer via holes 60 are arrayed along the long side 11*a* of the aperture 12 of the waveguide 10 relative to the second stripline SL2 and a part of the first stripline SL1. The array MX includes a short side portion MXb where the surface layer via holes 60 are arrayed along the short side 11*b* of the aperture 12 of the waveguide 10. There is a space in a planar direction between the surface layer via holes 60 constituting the long side portion MXa and the short side portion MXb, and the edge of the aperture 12 of the waveguide 10. The conductive foil 35 extends toward the cavity 11 side beyond the surface layer via holes 60 that are nearest to the cavity side of the surface layer via holes 60 constituting the long side portion MXa and the short side portion MXb. By giving a margin to the conductive foil 35 in such a manner, it becomes easier to form the surface layer via holes 60.

The array MX has a gate portion GT where the surface layer via holes 60 of the array is not provided in part on the long side portion MXa on the minus side of the aperture 12 along Y axis direction. The transmission line SL described above passes through the gate portion GT and reaches the inside of the array MX. The notch 13 of the waveguide 10 described above is located over at least a region of the gate portion GT through which the transmission line SL passes.

The inner layer via holes 70, as shown in FIG. 4, pass through the second board 40 and the third board 50. The inner layer via holes 70 are connected to the second foil 41. The lower end of the inner layer via holes 70 is connected to the third foil 51. The upper end of the inner layer via holes 70 is situated in the upper face of the second board 40 and connected to the first foil 31. Each of the inner layer via holes 70 is a conductive tube. The inner layer via hole may be a conductive pole.

As shown in FIG. 2, the inner layer via holes 70 are disposed directly below the gate portion GT relative to the array MX, or outside on the minus side along Y axis. The inner layer via holes 70 are disposed at a position where they are overlapped by the first stripline SL1 of the transmission line SL, as seen in a planar view, and where the conductive foil 35 does not cover on both sides of the first stripline SL1 in the X direction.

The first foil 31 is made of an electric conductor. A material of the first foil 31 may be, as an example, the same as the material of the conductive foil 35. As shown in FIG. 4, the first foil 31 is adhered to the lower surface of the first board 30. The first foil 31 covers at least a region of the lower surface under a region where the transmission line SL is disposed. However, the first foil 31 does not exist inside the array MX and on the plus side away from the end of the gate portion GT toward the plus direction in Y axis direction.

The second board 40 is made of fiber reinforced resin. A material of the second board 40 may be, as an example, the same as the material of the first board 30. The second board 40 is adhered to the lower surface of the first foil 31.

The second foil 41 is made of an electric conductor. A material of the second foil 41 may be, as an example, the same as the material of the first foil 31. The second foil 41 is adhered to the lower surface of the second board 40. The second foil 41 covers at least a region of the lower surface of the second board 40 located on the inner side of the array MX. Inside the square-shaped array MX, the length L from the surface of the first board 30 to the second foil 41 is larger than a quarter of a wavelength of a radio frequency electromagnetic wave in the first board 30 and the second board 40 and smaller than a half of the wavelength. The radio frequency electromagnetic wave is generated by the MMIC 80.

Note that the radio frequency electric power conversion mechanism of the present invention can be used for a frequency-modulated continuous-wave (FMCW) radar. In such a case, a frequency of a radio frequency electric power may have a width of the range in a practical sense, so that there is a width of the wavelength range. In such an application, the phrase "larger than a quarter of a wavelength" described above means "larger than a quarter of the smallest wavelength in a radio frequency band used". Similarly, the phrase "smaller than a half of a wavelength" means "smaller than a half of the largest wavelength in a radio frequency band used".

The third board 50 is made of fiber reinforced resin. A material of the third board 50 may be, as an example, the same as at least one of the first board 30 and the second board 40. The third board 50 is adhered to the lower surface of the second foil 41.

The third foil 51 is adhered to the lower surface of the third board 50. The third foil 51 is grounded.

That is, the third foil 51 is at the ground potential. The conductive foil 35 and the third foil 51 are grounded, so that the first foil 31, the second foil 41, the surface layer via holes 60 and the inner layer via holes 70 are grounded.

One or more of any of the first board 30, the second board 40 and the third board 50 may be a composite board including a plurality of boards and one or more foils. As the composite board, as an example, an FR-4 board used widely for a printed circuit board may be adopted. The FR-4 board can be provided by impregnating a glass fiber cloth with epoxy resin before curing and performing a thermosetting treatment of the resin.

The MMIC 80 can generate and receive a radio frequency electromagnetic wave in the frequency range of 70 GHz or more and 100 GHz or less. The MMIC 80 in this preferred embodiment, as an example, may generate and receive a radio frequency electromagnetic wave in the range whose center frequency is 76.5 GHz. The MMIC 80 is disposed in the upper surface of the first board 30.

In the radio frequency electric power conversion mechanism 1 described above, a radio frequency electromagnetic wave generated by the MMIC 80 propagates through the first stripline SL1 of the transmission line SL in a quasi-TEM mode and is converted from the quasi-TEM mode into a waveguide mode in the second stripline SL2 that functions as a radiation element. The radio frequency electromagnetic wave in a quasi-TEM mode converted into the waveguide mode is radiated from the second stripline SL2. A radio frequency electromagnetic wave radiated toward the plus side along Z axis proceeds toward the cavity 11 of the waveguide 10, while a radio frequency electromagnetic waves radiated toward the minus side along Z axis is reflected from the second foil 41 that forms a ground plane and then proceed toward the cavity 11 of the waveguide 10. The waveguide 10 contacts with the conductive foil 35 and the surface layer via holes 60 in the lower end surface of the waveguide 10. The surface layer via holes 60 are connected to the conductive foil 35, the first foil 31, the second foil 41 and the third foil 51. The conductive foil 35 and the third foil are grounded, so that the radio frequency electromagnetic wave generated by the MMIC 80 is prevented from leaking out.

Generally, in order that a radio frequency electromagnetic wave is brought into a resonant condition and thus the maximum electric power is radiated, the distance L from the surface of the first board 30 to the second foil 41 is a quarter of the wavelength, in the relevant site, of the radio frequency electromagnetic wave generated by the MMIC 80. In order that the radio frequency electromagnetic wave is brought into a resonant condition and thus the maximum electric power is radiated the length of the second stripline SL2 is a quarter of the wavelength, in the upper surface of the first board 30, of the radio frequency electromagnetic wave generated by the MMIC 80.

The inventors of this application have found a condition in the radio frequency electric power conversion mechanism 1 described above in which transmission efficiency of a radio frequency electromagnetic wave is enhanced.

More specifically, when the distance L from the surface of the first board 30 to the second foil 41, as described above, is larger than a quarter of a wavelength, in the relevant site, of a radio frequency electromagnetic wave generated by the MMIC 80, and smaller than a half of the wavelength, then the transmission efficiency is enhanced. When the length of the second stripline SL2 is equal to or larger than a quarter of the wavelength, in the upper surface of the first board 30, of the radio frequency electromagnetic wave generated by the MMIC 80, and equal to or smaller than a half of the wavelength, then the transmission efficiency is enhanced. When the distance L is larger than a quarter of the wavelength of the radio frequency electromagnetic wave inside the first board 30 and the second board 40, and smaller than a half of the wavelength, and when the length of the second stripline SL2 is equal to or larger than a quarter of the wavelength of the radio frequency electromagnetic wave, and equal to or smaller than a half of the wavelength, then the long side 11*a* of the cavity 11 of the waveguide 10 is preferably equal to or larger than a half of the wavelength in air of the radio frequency electromagnetic wave generated by the MMIC 80, and smaller than the wavelength in air of the radio frequency electromagnetic wave generated by the MMIC 80. When the distance L is larger than a quarter of the wavelength of the radio frequency electromagnetic wave, and smaller than a half of the wavelength, and when the length of the second stripline SL2 is equal to or larger than a quarter of the wavelength of the radio frequency electromagnetic wave, and equal to or smaller than a half of the wavelength, then the short side 11*b* of the cavity 11, as an example, is preferably equal to or larger than a quarter of the wavelength in air of the radio frequency electromagnetic wave generated by the MMIC 80, and smaller than a half of the wavelength.

Conventionally, the distance L has been preferably equal to a quarter of a wavelength of a radio frequency electromagnetic wave. It is considered that one reason why the transmission efficiency is enhanced when the distance L is larger than a quarter of the wavelength of the radio frequency electromagnetic wave, and smaller than a half of the wavelength is because the width of the long side portion MXa of the array MX, especially the width measured between edges of the via holes 60 on the inner side is slightly larger than the width of the cavity 11 of the waveguide 10 in the long side direction. Accordingly, the resonant condition of the radio frequency electromagnetic wave changes, and the distance L is set to a larger value than usual, thereby enhancing the transmission efficiency.

According to this preferred embodiment, the first board 30, the second board 40 and the third board 50 are made of fiber reinforced resin. According to this preferred embodiment, a radio frequency electromagnetic wave can be radiated or received without use of an expensive ceramic circuit board. Therefore, this preferred embodiment can provide a radio frequency electric power conversion mechanism capable of being reduced in production cost.

According to this preferred embodiment, because the radio frequency electric power conversion mechanism 1 includes the surface layer via holes 60 and the inner layer via holes 70, leaking out of a radio frequency electromagnetic wave could change the resonant condition. According to this preferred embodiment, inside the square-shaped array MX, the distance L from the surface of the first board 30 to the second foil 41 is larger than a quarter of a wavelength, in the relevant site, of a radio frequency electromagnetic wave generated by the MMIC 80, and smaller than a half of the wavelength. According to this preferred embodiment, when the MMIC 80 capable of generating and receiving a radio frequency wave within the frequency range of 70 GHz or more and 100 GHz or less is used, the transmission efficiency of the radio frequency electromagnetic wave can be enhanced.

According to this preferred embodiment, the inner layer via holes 70 are disposed outside the gate portion GT relative to the array MX. Therefore, according to this preferred embodiment, the radio frequency electromagnetic wave can be prevented from leaking out through the gate portion GT.

The preferred embodiment according to the present invention has been described above with reference to the accompanying drawings, and it goes without saying that the present invention is not limited to such an preferred embodiment. Various shapes and combinations of each of components shown in the preferred embodiment described above are one example, and various changes may be made based on engineering requirements without departing from the spirit and scope of the present invention.

For example, in the above preferred embodiment, the configuration including the third board 50 and the third foil 51 has been illustrated, but a configuration without the third board 50 and the third foil 51 may be implemented. In the configuration without the third board 50 and the third foil 51, the surface layer via holes 60 pass through the first board 30 and the second board, and are connected to the conductive foil 35, the first foil 31 and the second foil 41. In the configuration without the third board 50 and the third foil 51, the inner layer via holes 70 pass through the second board 40, and are connected to the first foil 31 and the second foil 41.

The site where the array MX is positioned, shown in the above preferred embodiment, may be provided with a fourth board made of fiber reinforced resin and covering at least part of the upper surface of the first board 30. If the configuration including the fourth board is adopted, preferably, the surface layer via holes 60 pass through the fourth board, and the upper end of the surface layer via holes 60 is exposed to the upper surface of the fourth board.

Figure 5:
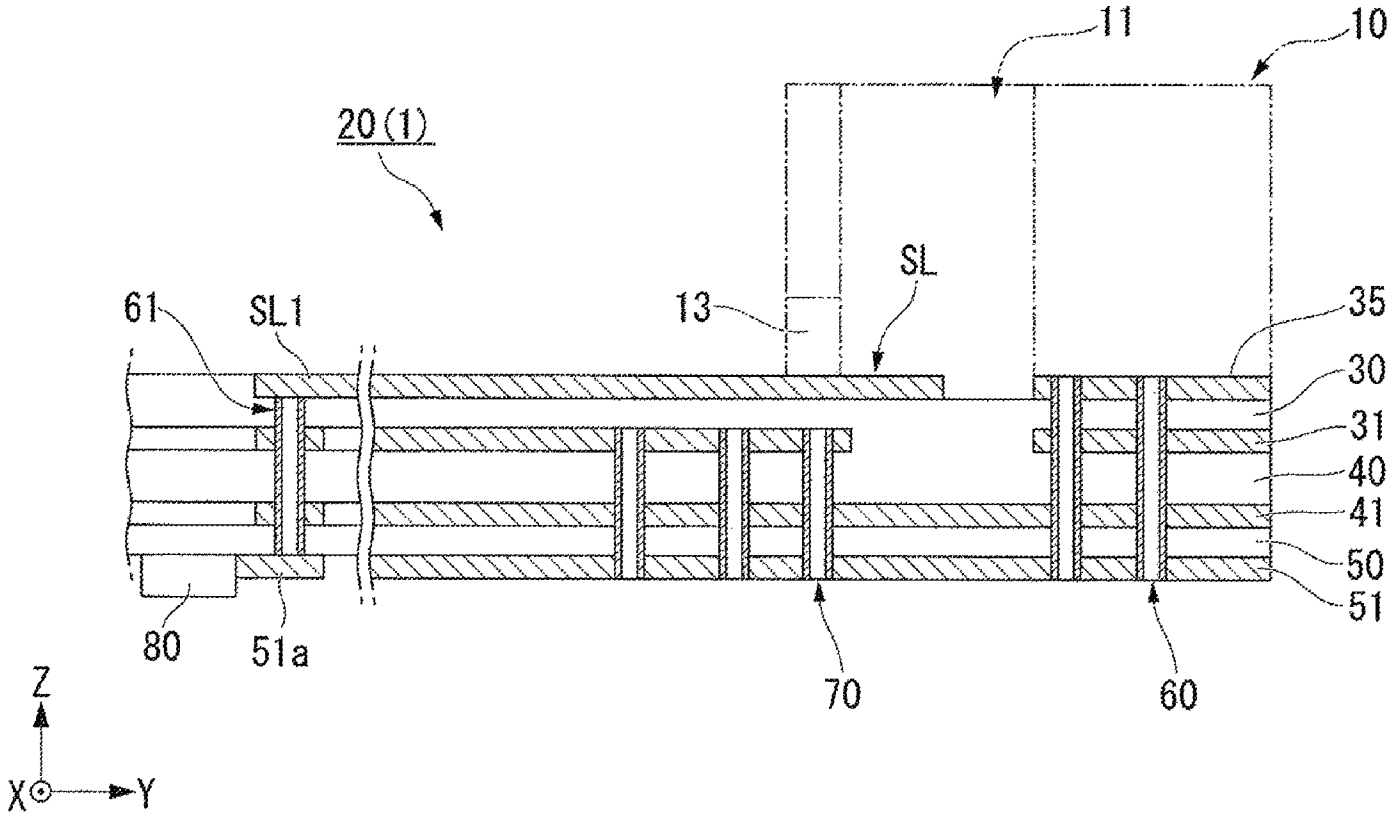
FIG. 5 is a partial cross-sectional view showing a modification in placement of a MMIC.

In the above preferred embodiment, the example where the MMIC 80 is disposed in the upper surface of the first board 30 has been illustrated. The MMIC 80, as an example, may be disposed in the lower surface of the third board 50, as shown in FIG. 5. If the MMIC 80 is disposed in the lower surface of the third board 50, a third foil 51*a* connected to the MMIC 80 is provided separately from the third foil 50. The third foil 51*a* is connected to the first stripline SL1 by through via holes 61 passing through the first board 30, the second board 40 and the third board 50.

Figure 6:
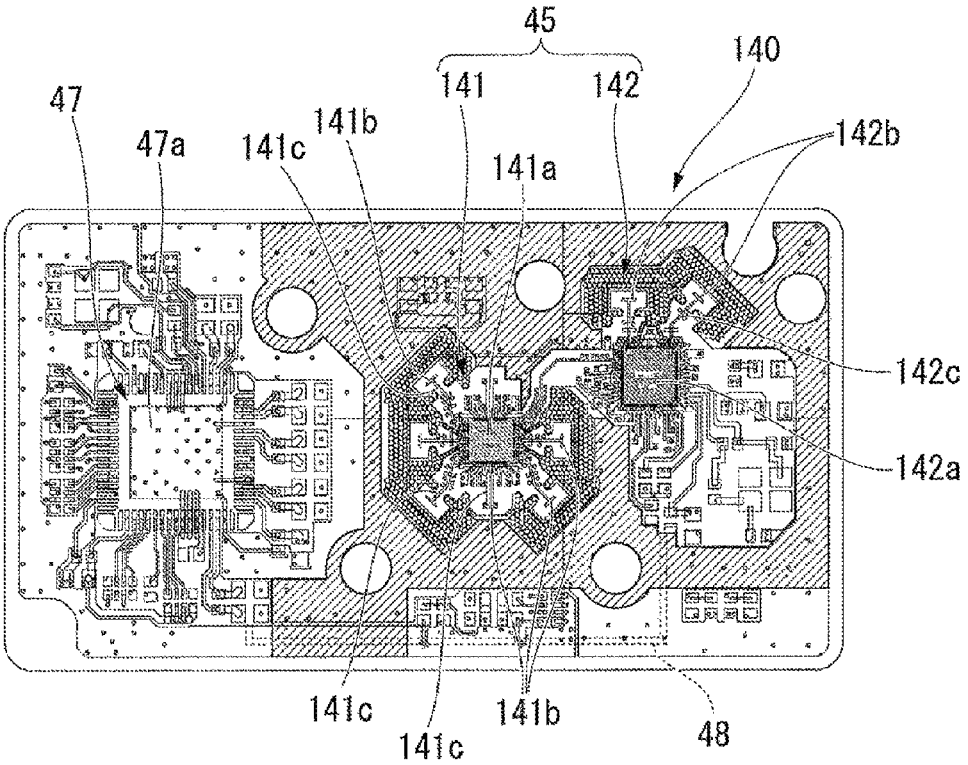
FIG. 6 is a plan view showing a modification where each of a receiving MMIC and a transmitting MMIC is individually provided in the circuit board.

Next, a modification in which each of a receiving MMIC and a transmitting MMIC is individually provided in the same circuit board is shown in FIG. 6. In FIG. 6, the view of the waveguide 10 is omitted.

A circuit board 140 is provided with a receiving radio frequency circuit portion 141, a transmitting radio frequency circuit portion 142 and an information processing circuit portion 47. In the circuit board 140, the information processing circuit portion 47, the radio frequency circuit portion 141 and the radio frequency circuit portion 142 are arranged in a plane so as not to be superposed on each other. The radio frequency circuit portion 141 and the radio frequency circuit portion 142 are disposed adjacent to each other, thus providing a radio frequency circuit region 45 as a whole. The circuit board 140 is provided with a signal line 48 to connect the radio frequency circuit portion 141, the radio frequency circuit portion 142 and the information processing circuit portion 47 to each other.

The information processing circuit portion 47 includes an information processing integrated circuit 47*a*. The information processing integrated circuit 47*a* functions to control the radio frequency circuit portion 141 and the radio frequency circuit portion 142, and process information. More particularly, the information processing integrated circuit 47*a* issues an order through the signal line 48 for the radio frequency circuit portion 142 to transmit a radio frequency electromagnetic wave. Also, the information processing integrated circuit 47*a* calculates information about reception of the radio frequency electromagnetic wave in the radio frequency circuit portion 141 through the signal line 48.

The radio frequency circuit portion 141 includes a receiving MMIC 141*a*, and five transmission lines (microstripline) 141*c* extending from the MMIC 141*a* and having a second stripline 141*b* on their end as an individual receiving terminal.

The radio frequency circuit portion 142 includes a transmitting MMIC 142*a*, and two transmission lines (microstripline) 142*c* extending from the MMIC 142*a* and having a second stripline 142*b* on their end as an individual transmitting terminal.

The receiving terminal 141*b* of the radio frequency circuit portion 141 receives a radio frequency electromagnetic wave propagating from the waveguide 10 and transmits it to the MMIC 141*a*.

The transmitting terminal 142*b* of the radio frequency circuit portion 142 radiates an electromagnetic wave transmitted from the MMIC 142*a*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A radio frequency electric power conversion mechanism including a waveguide and a circuit board having a plurality of fiber reinforced resin boards, comprising:

a monolithic microwave integrated circuit (MMIC);

a first board made of fiber reinforced resin;

a transmission line which is a strip-like foil or a wire made of an electric conductor, the transmission line being adhered to an upper surface of the first board and having one end connected to the MMIC;

a first foil made of an electric conductor, the first foil being adhered to a lower surface of the first board and covering at least an area of the lower surface under a region where the transmission line is disposed;

a second board made of fiber reinforced resin and adhered to a lower surface of the first foil;

a second foil made of an electric conductor and adhered to a lower surface of the second board;

a waveguide extending in a direction away from the upper surface of the first board and including a cavity having a square-shaped cross-section therein; and plural surface layer via holes each of which is a conductive tube or pole passing through at least the first board and the second board, connected to the second foil, and having an upper end exposed to a surface of the circuit board; wherein the waveguide has a square-shaped aperture on its lower end;

at least part of the plural surface layer via holes constitute an array surrounding at least three sides of the other end of the transmission line;

a lower end surface of the waveguide is adhered to upper end faces of the surface layer via holes constituting the array;

the array includes a long side portion and a short side portion where the surface layer via holes are arranged along a long side and a short side of the aperture, respectively;

the surface layer via holes constituting the array are not positioned inside the aperture, as seen through the waveguide guide;

the array includes a gate portion where the surface via holes is not provided entirely on one of the long side portions or in part on the long side portions;

the waveguide includes a notch opening toward the lower end surface in the side surface of the lower end of the waveguide;

the transmission line passes through the gate portion and reaches the inside of the array, the notch is located over at least a region of the gate portion through which the transmission line passes;

the second foil covers at least a region of the lower surface of the second board located on an inner side of the array;

the MMIC is disposed in one of the upper and lower surfaces of the first or second board;

the first foil, the second foil and the surface layer via holes constituting the array are grounded;

a long side of a cross-section of the waveguide is equal to or larger than a half of a wavelength of a radio frequency electromagnetic wave in air, generated by the MMIC, and smaller than the wavelength; and a short side of the cross-section of the waveguide is equal to or larger than a quarter of the wavelength of the radio frequency electromagnetic wave in air, generated by the MMIC, and equal to or smaller than a half of the wavelength.

2. The radio frequency electric power conversion mechanism according to claim 1, wherein the MMIC can generate and receive a radio frequency wave having a frequency range of 70 GHz or more and 100 GHz or less; and on the inner side of the square-shaped array, a distance from a surface of the first board to the second foil is larger than a quarter of a wavelength of a radio frequency electromagnetic wave and smaller than a half of the wavelength.

3. The radio frequency electric power conversion mechanism according to claim 1, further comprising:

a conductive foil connecting the surface layer via holes constituting the array with one another in the upper surface of the first board, wherein a space exists, in a planar direction, between an edge of the aperture of the waveguide and the surface layer via holes constituting the long side portion, and between the edge of the aperture of the waveguide and the short side portion of the array.

4. The radio frequency electric power conversion mechanism according to claim 2, further comprising:

a conductive foil connecting the surface layer via holes constituting the array with one another in the upper surface of the first board, wherein a space exists, in a planar direction, between an edge of the aperture of the waveguide and the surface layer via holes constituting the long side portion, and between the edge of the aperture of the waveguide and the short side portion of the array.

5. The radio frequency electric power conversion mechanism according to claim 1, further comprising:

a third board made of fiber reinforced resin and adhered to a lower surface of the second foil, wherein the surface layer via holes pass through the third board; and one or more of the first board, the second board and the third board are a composite board including a plurality of boards and one or more foils.

6. The radio frequency electric power conversion mechanism according to claim 2, further comprising:

a third board made of fiber reinforced resin and adhered to a lower surface of the second foil, wherein the surface layer via holes pass through the third board; and one or more of the first board, the second board and the third board are a composite board including a plurality of boards and one or more foils.

7. The radio frequency electric power conversion mechanism according to claim 3, further comprising:

a third board made of fiber reinforced resin and adhered to a lower surface of the second foil, wherein the surface layer via holes pass through the third board; and one or more of the first board, the second board and the third board are a composite board including a plurality of boards and one or more foils.

8. The radio frequency electric power conversion mechanism according to claim 4, further comprising:

a third board made of fiber reinforced resin and adhered to a lower surface of the second foil, wherein the surface layer via holes pass through the third board; and one or more of the first board, the second board and the third board are a composite board including a plurality of boards and one or more foils.

9. The radio frequency electric power conversion mechanism according to claim 1, further comprising:

at least one inner layer via hole that is a conductive tube or pole passing through the second board, and has a lower end connected to the second foil and an upper end positioned in an upper surface of the second board; wherein the at least one inner layer via hole is positioned outside the gate portion relative to the array.

10. The radio frequency electric power conversion mechanism according to claim 2, further comprising:

at least one inner layer via hole that is a conductive tube or pole passing through the second board, and has a lower end connected to the second foil and an upper end positioned in an upper surface of the second board; wherein the at least one inner layer via hole is positioned outside the gate portion relative to the array.

11. The radio frequency electric power conversion mechanism according to claim 8, further comprising:

at least one inner layer via hole that is a conductive tube or pole passing through the second board, and has a lower end connected to the second foil and an upper end positioned in an upper surface of the second board; wherein the at least one inner layer via hole is positioned outside the gate portion relative to the array.

12. The radio frequency electric power conversion mechanism according to claim 1, wherein the transmission line includes a first stripline extending in a direction parallel to the short side and having one end connected to the MMIC and a second stripline extending in a direction intersecting the first stripline and connected to the other end of the first stripline.

13. The radio frequency electric power conversion mechanism according to claim 2, wherein the transmission line includes a first stripline extending in a direction parallel to the short side and having one end connected to the MMIC and a second stripline extending in a direction intersecting the first stripline and connected to the other end of the first stripline.

14. The radio frequency electric power conversion mechanism according to claim 11, wherein the transmission line includes a first stripline extending in a direction parallel to the short side and having one end connected to the MMIC and a second stripline extending in a direction intersecting the first stripline and connected to the other end of the first stripline.

15. The radio frequency electric power conversion mechanism according to claim 1, further comprising:

a surface layer foil made of an electric conductor and adhered to the upper surface of the first board, wherein the transmission line is a part of the surface layer foil: and at least part of a surface of the surface layer foil is covered with gold.

16. The radio frequency electric power conversion mechanism according to claim 14, further comprising:

a surface layer foil made of an electric conductor and adhered to the upper surface of the first board, wherein the transmission line is a part of the surface layer foil: and at least part of a surface of the surface layer foil is covered with gold.

17. The radio frequency electric power conversion mechanism according to claim 1, further comprising:

at a site where the array is positioned, a fourth board made of fiber reinforced resin and covering at least part of the upper surface of the first board; wherein the surface layer via holes pass through the fourth board, and the upper ends of the surface layer via holes are exposed to an upper surface of the fourth board.

18. The radio frequency electric power conversion mechanism according to claim 16, further comprising:

at a site where the array is positioned, a fourth board made of fiber reinforced resin and covering at least part of the upper surface of the first board; wherein the surface layer via holes pass through the fourth board, and the upper ends of the surface layer via holes are exposed to an upper surface of the fourth board.

19. The radio frequency electric power conversion mechanism according to claim 1, wherein the fiber reinforced resin is a glass epoxy resin; and the first foil and the second foil are made of pure copper or copper alloy.

20. The radio frequency electric power conversion mechanism according to claim 18, wherein the fiber reinforced resin is a glass epoxy resin; and the first foil and the second foil are made of pure copper or copper alloy.

* * * * *